US006099043A

United States Patent [19]

Story

[11] Patent Number: 6,099,043

[45] Date of Patent: Aug. 8, 2000

[54] COUPON CATALOGUE APPARATUS

[76] Inventor: Gerald A. Story, 4949 E. Shaw Butte, Scottsdale, Ariz. 85254-4662

[21] Appl. No.: 08/908,899

[22] Filed: Aug. 8, 1997

Related U.S. Application Data

[63] Continuation of application No. 08/421,950, Apr. 14, 1995, abandoned.

[51] Int. Cl.[7] ..... B42D 15/00

[52] U.S. Cl. ..... 283/99; 283/51; 283/56; 283/100; 283/102; 281/15.1

[58] Field of Search ..... 283/98, 99, 117, 283/51, 56, 100, 105, 112, 114, 67, 102; 281/15.1; 235/493

[56] References Cited

U.S. PATENT DOCUMENTS

| | | | |
|---|---|---|---|
| 3,211,470 | 10/1965 | Wilson | 283/81 X |
| 4,397,417 | 8/1983 | Carlson | 229/92.3 |
| 4,575,624 | 3/1986 | Klinkhardt | 235/493 X |
| 4,920,675 | 5/1990 | Mashimo | 283/56 X |
| 4,984,825 | 1/1991 | Fowler | 283/99 X |
| 5,106,090 | 4/1992 | Greenwood | 283/903 X |
| 5,246,252 | 9/1993 | Gaddis | 283/99 X |
| 5,359,183 | 10/1994 | Skodlar | 235/493 |
| 5,466,010 | 11/1995 | Spooner | 283/56 X |
| 5,489,763 | 2/1996 | Conrad et al. | 235/380 X |
| 5,501,491 | 3/1996 | Thompson | 283/70 |
| 5,531,482 | 7/1996 | Blank | 283/67 X |
| 5,536,045 | 7/1996 | Adams | 283/56 X |

FOREIGN PATENT DOCUMENTS

| | | | |
|---|---|---|---|
| 2258424 | 2/1993 | United Kingdom | 283/56 |

*Primary Examiner*—Frances Han
*Attorney, Agent, or Firm*—Harry M. Weiss; Harry M. Weiss & Associates, P.C.

[57] ABSTRACT

A coupon catalogue comprising a pack of equal sized cards which is readily concealable and carried on the person in a clothing pocket or a purse or a wallet, which can be fanned to expose all of the cards in the pack for simultaneous viewing, and which can be utilized to obtain complimentary goods and services without requiring that portions of the catalogue be torn, punched, marked, or located by using a table of contents in the coupon catalogue.

3 Claims, 5 Drawing Sheets

COUPON CATALOGUE APPARATUS

This application is a continuation of application Ser. No. 08/421,950, filed on Apr. 14, 1995, which is now abandoned.

This invention relates to a coupon catalogue apparatus and to a method for determining the frequency of usage of such apparatus.

More particularly, the invention relates to a coupon catalogue comprising a pack of equal sized cards which is readily concealable and carried on the person in a clothing pocket or a purse or a wallet and which can be fanned to expose all of the cards in the pack for simultaneous viewing.

In a further respect, the invention relates to a coupon catalogue which can be utilized to obtain complimentary goods and services without requiring that portions of the catalogue be torn, punched, marked, or located by using a table of contents in the coupon catalogue.

In still another respect, the invention relates to a coupon catalogue which does not require the use of paper or wood products and which promotes the environmentally preferred preservation of trees.

The sale of coupon catalogues comprises a large business in the United States of America. Coupon catalogues typically comprise bound paperback books which have a thickness equal to or greater than about one inch and which typically have a length of about five to six inches and a width of about three to four inches. The coupon catalogues include pages with coupons which enable the bearer of each of the coupons to obtain complimentary goods and services. For example, one coupon in the coupon book may enable the bearer to obtain a free drink or meal at a restaurant. Another coupon in the coupon book may offer a "Two-for-One " opportunity in which the bearer obtains a free product when he pays for at least one of the product, and so on.

While such bound paperback coupon catalogues have been marketed for many years, the catalogues have long suffered from disadvantages which do not make the catalogues user friendly. First, the size of the coupon book makes it impractical to carry on the person. The book cannot be inserted in a pant or shirt pocket or in a wallet. While some purses will accommodate the coupon book, the weight and size of the book make it unwieldy and impractical to carry. Second, the long-used layout format of the paperback coupon book does not permit ready reduction in the size of the book. Third, since the coupon book is not carried on the person, it must be stored in the user's residence, office, or car, which means the coupon book often is easily misplaced and is not readily found when the user desires to utilize the coupon book. Fourth, each time the user wishes to find a coupon for a specific business entity, he must either consult a table of contents in the catalogue or flip through a group of pages each provided with the same color coding or each under the same marking tab and each pertaining to a particular type of business. Fifth, once the appropriate coupon is located, it must be torn from the book. Sixth, after the coupon is removed from the coupon book, the coupon is often misplaced or is difficult to find before it is utilized.

Accordingly, it would be highly desirable to provide a coupon catalogue which could be carried on the person in a pocket or wallet, which would have a layout format that would foster a significant reduction in the size of the coupon catalogue, which would reduce the likelihood that the coupon catalogue would be misplaced, which would not require that the bearer of the coupon catalogue consult a table of contents or flip through multiple pages each pertaining to the same kind of business, which would not require that pages be torn from the coupon catalogue, and which would eliminate the possibility that a portion of the coupon catalogue could be separated from the catalogue and lost.

Therefore, it is a principal object of the invention to provide an improved coupon catalogue.

A further object of the invention is to provide an improved coupon catalogue having a layout format which permits a significant reduction in the size of the coupon catalogue in comparison to conventional bound paperback coupon catalogues.

Another object of the invention is to provide an improved coupon catalogue which can be readily concealed on the person and which reduces the likelihood that the coupon catalogue will be misplaced in the user's office, residence, or vehicle.

Still a further object of the invention is to provide an improved coupon catalogue which does not require that a user consult a table of contents in the catalogue in order to make practical use of the catalogue.

Yet still another object of the invention is to provide an improved coupon catalogue which does not require that portions of the catalogue be removed and stored in locations separate from the catalogue.

Another object of the invention is to provide an improved coupon catalogue and method which permits the ready monitoring of frequency of use of the catalogue at a particular business establishment.

A further object of the invention is to provide an improved coupon catalogue of the type described which permits a user to activate a display which produces a jingle associated with one of the business establishments providing complimentary goods or services in the coupon catalogue.

These and other, further and more specific objects and advantages of the invention will be apparent to those skilled in the art from the following detailed description thereof, taken in conjunction with the drawings, in which.

Figure 1:
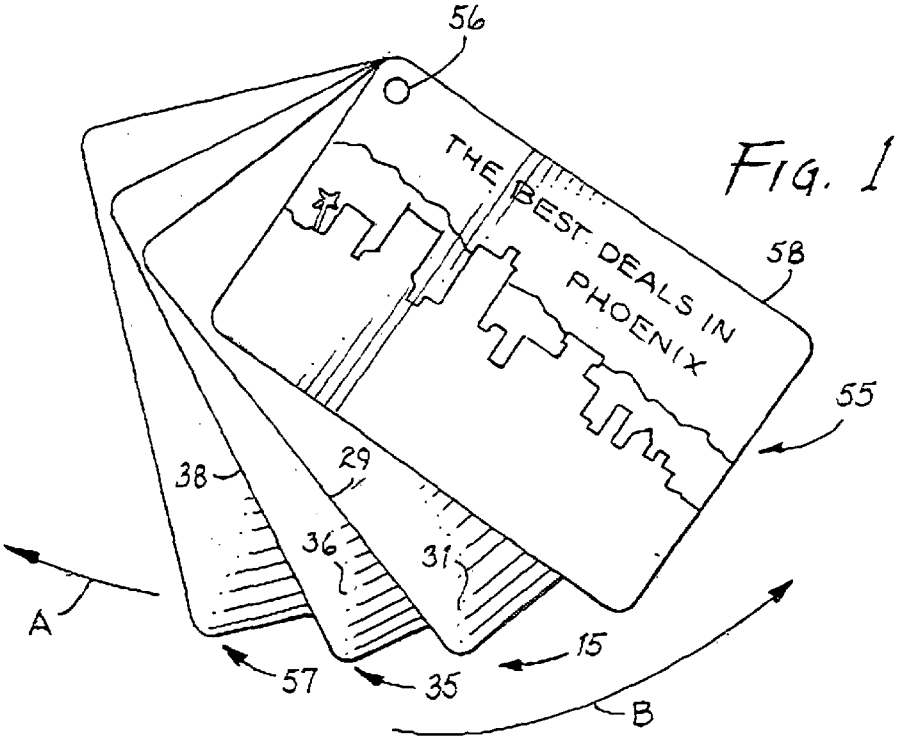
FIG. 1 is a top view illustrating a coupon catalogue constructed in accordance with the invention and further illustrating the mode of operation thereof.

Briefly, in accordance with my invention, I provide an article of manufacture comprising a coupon catalogue apparatus. The coupon catalogue apparatus includes a plurality of cards of substantially equal shape and dimension and each having a peripheral edge; a fastener for pivotally attaching the cards at a point adjacent the peripheral edge of each of the cards to maintain the cards in a stacked registered configuration and to permit each of the cards to pivot about the point to fan out from the stacked registered configuration; machine readable indicia on each card uniquely identifying the card; at least one source indicia on each card identifying the source of complimentary goods or services offered to the bearer of the card; and, at least one confirmation indicia associated with the source indicia on each card and alterable to confirm that the bearer of the catalogue used the catalogue to obtain the goods or services offered by the source of the goods or services identified on the card.

In another embodiment of my invention, I provide an article of manufacture comprising a coupon catalogue apparatus. The coupon catalogue apparatus includes a plurality of cards of substantially equal shape and dimension and each having a peripheral edge; a fastener for pivotally attaching the cards at a point adjacent the peripheral edge of each of the cards to maintain the cards in a stacked registered configuration and to permit the cards to pivot and about said point to fan out from the stacked registered configuration; a plurality of source indicia on each card each identifying a different source of complimentary goods or services offered to the bearer of the card; goods identification indica on each card generally categorizing the type of goods or services offered by the sources; a plurality of confirmation indicia each associated with one of the source indicia on each card and removable from the card by scratching to confirm that the bearer of the catalogue apparatus used the catalogue apparatusto obtain the complimentary goods or services offered by one of the sources of the goods or services identified on the card.

In a further embodiment of my invention, I provide an article of manufacture comprising a coupon catalogue apparatus including a credit card-sized card having a peripheral edge; at least one source indicia on the card identifying the source of complimentary goods or services offered to the bearer of the card; a plurality of confirmation indicia each associated with the source indicia on the card and alterable to confirm that the bearer of the catalogue used the catalogue to obtain the goods or services offered by the source; a memory for storing activation information for producing signals associated with the source; a display; a microprocessor for recalling the activation information and converting the activation information to display signals; and, an audio speaker responsive to the display signals to produce an audible jingle associated with the source.

In still another embodiment of the invention, I provide a method of determining the frequency with which a customer frequents a source to purchase goods or services offered by the source. The method includes the steps of providing the customer a coupon catalogue apparatus. The coupon catalogue apparatus includes at least one card having a peripheral edge; machine readable unique identification indicia on the card identifying the card; source indicia on the card identifying the source as the provider of complimentary goods or services described on the card; at least one confirmation indicia associated with the source indicia on the card and alterable to confirm that the bearer of the catalogue used the card to obtain the complimentary goods or services offered by the source. The method also includes the step of reading the identification indicia with a machine when the customer frequents the source. The machine stores the unique identification indicia on the card in memory; and, calculates the number of times which the machine has read said unique identification indicia during a selected period of time.

Turning now to the drawings, which depict the presently preferred embodiments of the invention for the purpose of illustrating the practice thereof, and not by way of limitation of the scope of the invention, and in which like characters refer to corresponding elements throughout the several views, FIG. 1 illustrates a card catalogue apparatus constructed in accordance with the invention and including a plurality of credit card-size cards 55, 15, 35, and 57. Each card has an aperture formed in one corner such that a rivet 56 or other fastener can be utilized to attach pivotally the cards such that the cards can be stored and carried in a stack or "pack" storage configuration in which each card is aligned on top of or beneath and in registration with the remaining cards in the pack, and such that the cards can be fanned out in the direction of arrow A about the pivot point or rivet 56 in the manner shown in FIG. 1 to permit all of the cards to be at least partially exposed simultaneously. The card catalogue apparatus of FIG. 1 can be returned to a "pack" storage configuration by holding card 55 stationary and by pivoting the remaining cards 15, 35, 57 about rivet 56 in the direction of arrow B until all four cards are in registration above or beneath one another. Each card is sized to readily fit into a wallet, pant pocket, or purse and is presently preferably about three and three-eighths inches long by two and one-eighth inches wide. The shape and dimension of the cards utilized in accordance with the invention can vary as desired. It is, however, preferred that the cards be sized and shaped to be readily carried and concealed on the person and in wallets and purses.

Figure 2:
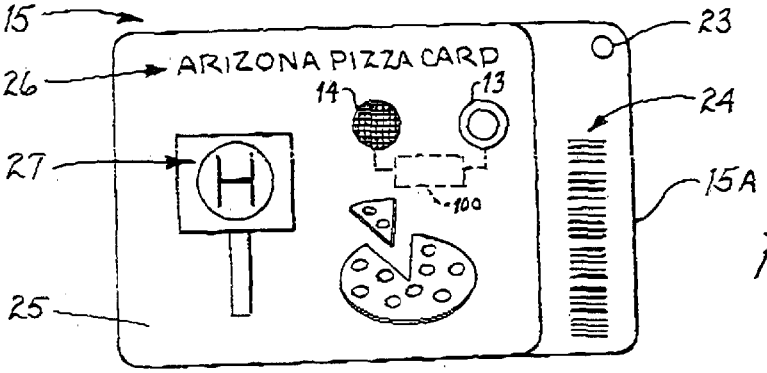
FIG. 2 is a back view illustrating one of the cards in the card catalogue of FIG. 1.

The back 25 of card 15 is illustrated in FIG. 2 and includes machine readable indicia 24, source indicia 27, and geographical goods-and-services category indicia 26 formed thereon. An aperture 23 is formed through one corner of the card 15 to receive rivet 56. Card 15 includes generally rectangular peripheral edge 15A.

The machine-readable indicia 24 presently comprises a bar code. Each card distributed in a selected geographical area has its own unique bar code. Consequently, each card 55, 15, 35, 57 has a bar code which is different from the bar code of the other cards in the coupon catalogue of FIG. 1 and which is also different from the bar code on each card in all other cards in all other coupon catalogues distributed in a selected geographical area. The geographical area selected can be a city or town, a state, a country, a continent, the world, or part of any such selected geographical area. Any desired machine-readable indicia other than a bar code may be utilized on a card 55, 15, 35, 57. The machine-readable indicia can be imprinted on a card, stored in a magnetic strip on a card, or formed in any other desired manner on or in the card so a machine can optically, electrically, magnetically, or otherwise detect and read the indicia. The other source, goods-and-services category, and other indicia on the cards in the coupon catalogue apparatus can be imprinted or formed in any other desired manner on or in the card so that the user can view, hear, smell or touch the indicia.

The source indicia 27 is a trademark, service mark, or logo which indicates the source, i.e. the business entity, which provides the goods or services noted on the card. The source indicia 27 consists of a trademark comprising a "H" in a circle.

The geographical goods-and-services category indicia 26 indicates the geographical area (the state of Arizona in the United States of America) in which the coupon catalogue apparatus is initially distributed and the kind of complimentary goods and services (Pizza) offered on the card.

The back 25 of card 15 also includes a button 31 which, as will be explained later, causes an audible jingle to emanate from speaker 14 when the button 31 is depressed.

The front 31 of card 15 includes source indicia 27 and 28 which indicates the source which provides the goods (pizza)

noted on the card. Source indicia 27 consists of the "H in circle" logo or trademark. Source indicia 28 consists of the "HANNIBAL PIZZA" trademark.

The goods-and-services category indicia 30 identifies the complimentary goods (pizza) obtainable by using the coupon catalogue apparatus and card 15 of the invention.

A plurality of alterable rectangular areas 29 are formed on the front 31 of the card 15. Each card 55, 15, 35, 57 is preferably made of a smooth plastic and each area 29 presently preferably consists of a material which is deposited on and may be rubbed or scratched from the front of the plastic card each time the card is utilized to obtain complimentary goods and services. Consequently, since there are twelve (12) areas 29 on the front 31, the card 15 can be utilized twelve times to obtain a free medium pizza each time a medium pizza is purchased.

Figure 4:
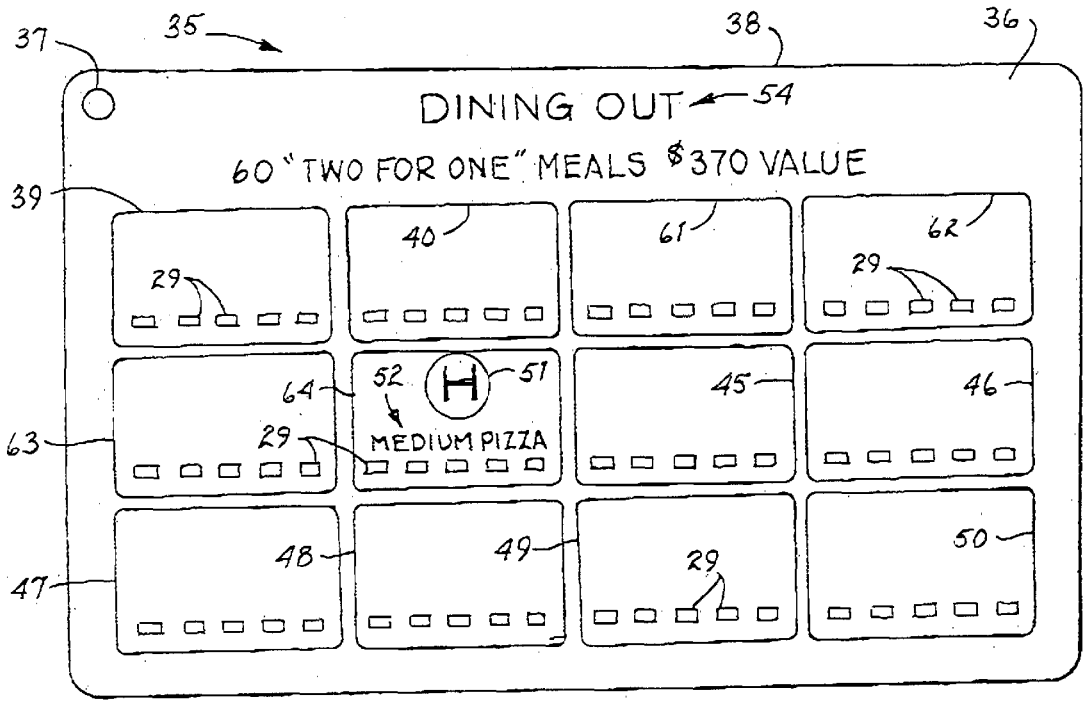
FIG. 4 is a front view illustrating another of the cards in the card catalogue of FIG. 1.
Figure 5:
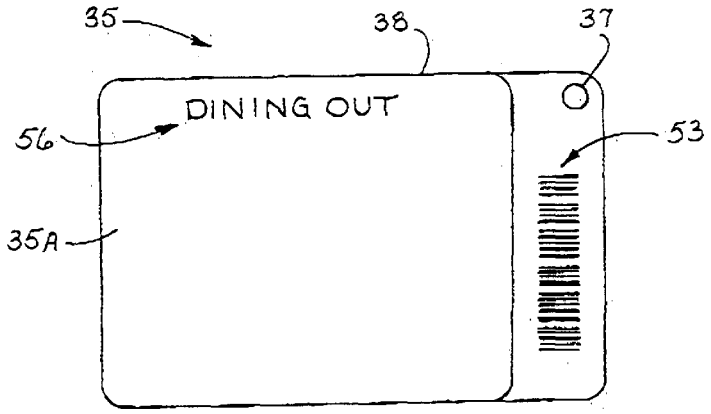
FIG. 5 is a back view further illustrating construction details of the card of FIG. 4.

Card 35 is illustrated in FIGS. 4 and 5 and includes peripheral edge 38 and aperture 37 formed through one corner to receive rivet 56. The front 36 of card 35 includes goods-and-services category indicia 54 which identifies the complimentary goods or services ("Dining Out", i.e. restaurant services) offered to bearers of the card 35. Twelve rectangular areas 39, 40, 61, 62, 63, 64, 45 to 50 of equal size are marked off or encircled with a line on the front 36 of card 35. Five alterable rectangular areas 29 are formed in each rectangular area 39, 40, 61 to 64, 45 to 50. As earlier noted, each area 29 presently preferably consists of a material which is deposited on and may be rubbed or scratched from the front of the card. Each of the twelve rectangular areas 39, 40, 61 to 64, 45 to 50 also (in addition to areas 29) includes goods-and-services category indicia (for example indicia 52 in area 64) and source indicia (for example indicia 51 in area 64). Such goods-and-services category indicia and source indicia are, for the sake of clarity, only illustrated in area 64 and are omitted from areas 39, 40, 61 to 63, and 46 to 50 in FIG. 4. The format illustrated in FIG. 4 for grouping twelve restaurants (or any other group of like business entities) on the side of a single card enables the size of a coupon catalogue to be significantly reduced in comparison to conventional bound paperback coupon catalogues. Rectangular areas 39, 40, 61 to 64, 45 to 50 are each presently about three-fourths of an inch long and about one-half inch wide or high. Rectangular areas 29 are presently about one-sixteenth of an inch long and about one-thirty second of an inch high. Reducing the size of areas 39, 40, 61 to 64, 45 to 50 to an area which is less than about 0.375 square inches is difficult and is presently not preferred. Reducing the size of areas 29 to a size which is less than about 0.004 square inches is difficult and is presently not preferred.

The goods-and-services category indicia 56 on the back 35A of the card 35 is illustrated in FIG. 5 and comprises the words "DINING OUT". The back 35A of card 35 also includes machine-readable bar code indicia 53 which uniquely identifies card 35 with respect to cards 15, 55, 57 and with respect to all other cards in all other coupon catalogue apparatus distributed in a selected geographical area. For example, indicia 53 can indicate the identification number "20805" while the indicia 24 on card 15 can indicate the identification number "20804". Each card has its own unique identification number.

The goods-and-services offered on any card for like businesses consist of any desired category of goods and services. For example, on card 35, the goods-and-services category indicia 54 can be replaced by the words "SPORTS & RECREATION" and the source indicia (for example indicia 51 in area 64) and the goods-and-services category indicia (for example indicia 52 in area 64) for each area 39, 40, 61 to 64, 45 to 50 can pertain to sports and recreation. For example, one area 39 might show the "DISNEYLAND" mark as the source indicia and might include goods-and-service category indicia which state "Free Space Mountain Ride". The remaining areas 40, 61 to 64, 45 to 50 would each includes source indicia and goods-and-services category indicia pertaining to sports and recreation. Or, by way of further example, card 57 could include indicia 54 stating "ARTS & ENTERTAINMENT" and could include in each of the areas 39, 40, 61 to 64, source indicia and goods-and-services category indicia pertaining to businesses which offer arts and entertainment goods or services.

Each coupon catalogue preferably, but not necessarily, includes only a single card for each kind of goods and services. For example, if a coupon catalogue apparatus includes:

- a first card with indicia 54 stating "DINING OUT" and with associated source indicia and goods-and-services category indicia pertaining only to restaurants,
- a second card with indicia 54 stating "HEALTHY DINING & FITNESS" and with associated source indicia and goods-and-services category indicia pertaining only to healthy dining and fitness establishments,
- a third card with indicia 54 stating "SPORTS & RECREATION" and with associated source indicia and goods-and-services category indicia pertaining only to sports and recreation products and services, and
- a fourth card with indicia 54 stating "ARTS & ENTERTAINMENT" and with associated source indicia and goods-and-services category indicia pertaining only to arts and entertainment products and services, then the coupon catalogue apparatus includes only a single card for each type of goods and services noted by the indicia 54 on the cards. Such an arrangement greatly simplifies the task of a user in identifying the card which includes the particular kind of business establishment desired by the user at any given time.

Figure 6:
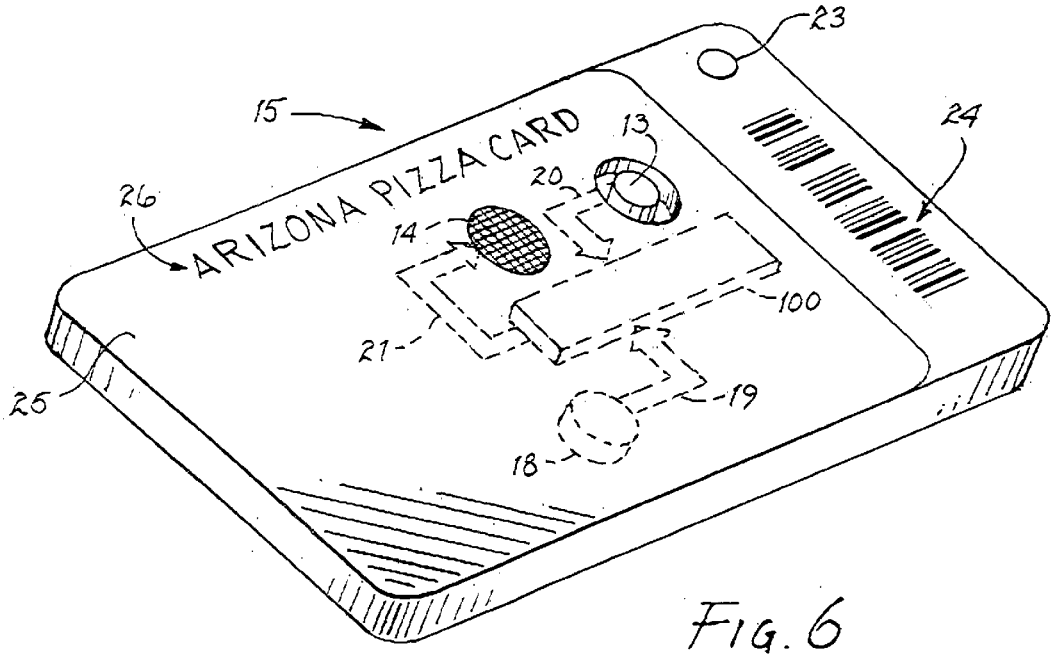
FIG. 6 is a perspective view of the card of FIG. 2 illustrating further internal construction details thereof.

Card 15 includes an audio system for producing an audible jingle associated with a business entity. The audio system is illustrated in FIG. 6 and includes a microprocessor chip 100 including a controller and a memory, a depressible button 13, a speaker 14, and a power supply 18. The microprocessor 100 can be, for example, an Intel 8048 single chip microcomputer with the program masked thereon and the power supply 38 can be a conventional lithium battery. The functional relationship and electrical interconnection of these components is well known in the art and are represented by the arrows 19, 20, and 21.

Figure 7:
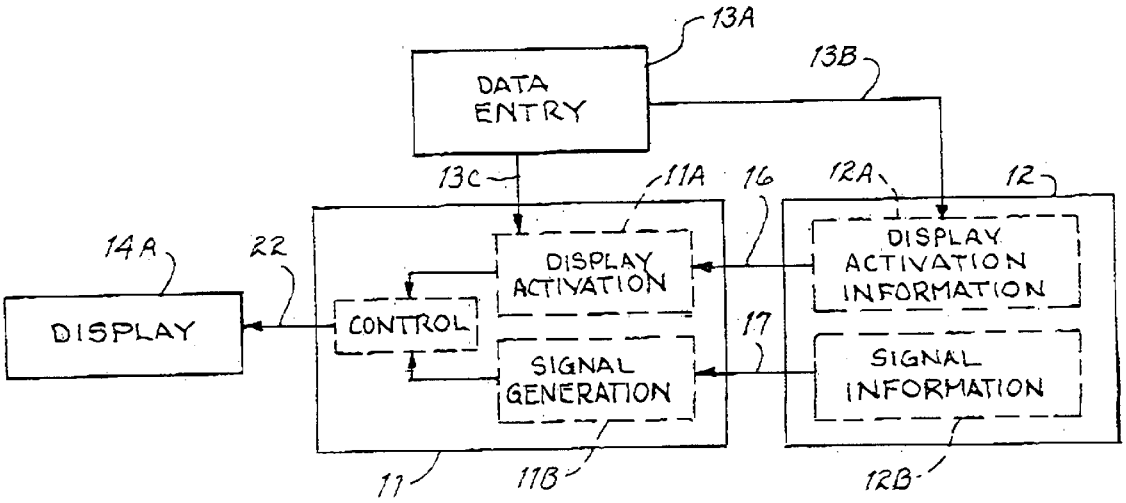
FIG. 7 is a block diagram illustrating the improved display system utilized in at least one of the cards in a coupon catalogue constructed in accordance with the invention.

FIG. 7 is a block diagram which illustrates a preferred embodiment of the audio system used in card 15. The main components of the audio system are a controller 11 and a memory 12. A display 14A and data entry 13 are provided. The display 14A can comprise a speaker 14, LED display, paper tape-printer, or any other desired means for displaying sound, alphanumeric characters, and/or other indicia or pictorial representations. Data entry 13 can comprise a button 13, computer key board, or any other desired means for inputting information to controller 11 and/or memory 12.

As indicated by the dashed lines, the controller 11 performs the dual function of display activation 11A and signal generation 11B. The memory contains display activation information 12A and signal information 12B. After data entry 13A (button 13) transmits 13B a signal to be stored in display activation information 12A and after the signal information 12B is stored in memory. Then during subsequent operational cycles this information is recalled from the memory 12 and the recalled information 16, 17 is fed to the controller 11, which activates the display 14A (for example, audio speaker 14).

The signal information 12B normally is stored in memory 12 before the card 15 is given to a user to obtain complimentary goods or services. The signal information 12B comprises a jingle associated with at least one of the business entities whose trademark or service mark appears on card 15. The jingle can comprise music, music and lyrics, words, pictorial representation and/or indicia or symbols associated with a business entity. The jingle typically is relatively short, but can be longer if desired, and can, for example, comprise a commercial or advertisement or can comprise an infomercial.

Figure 8:
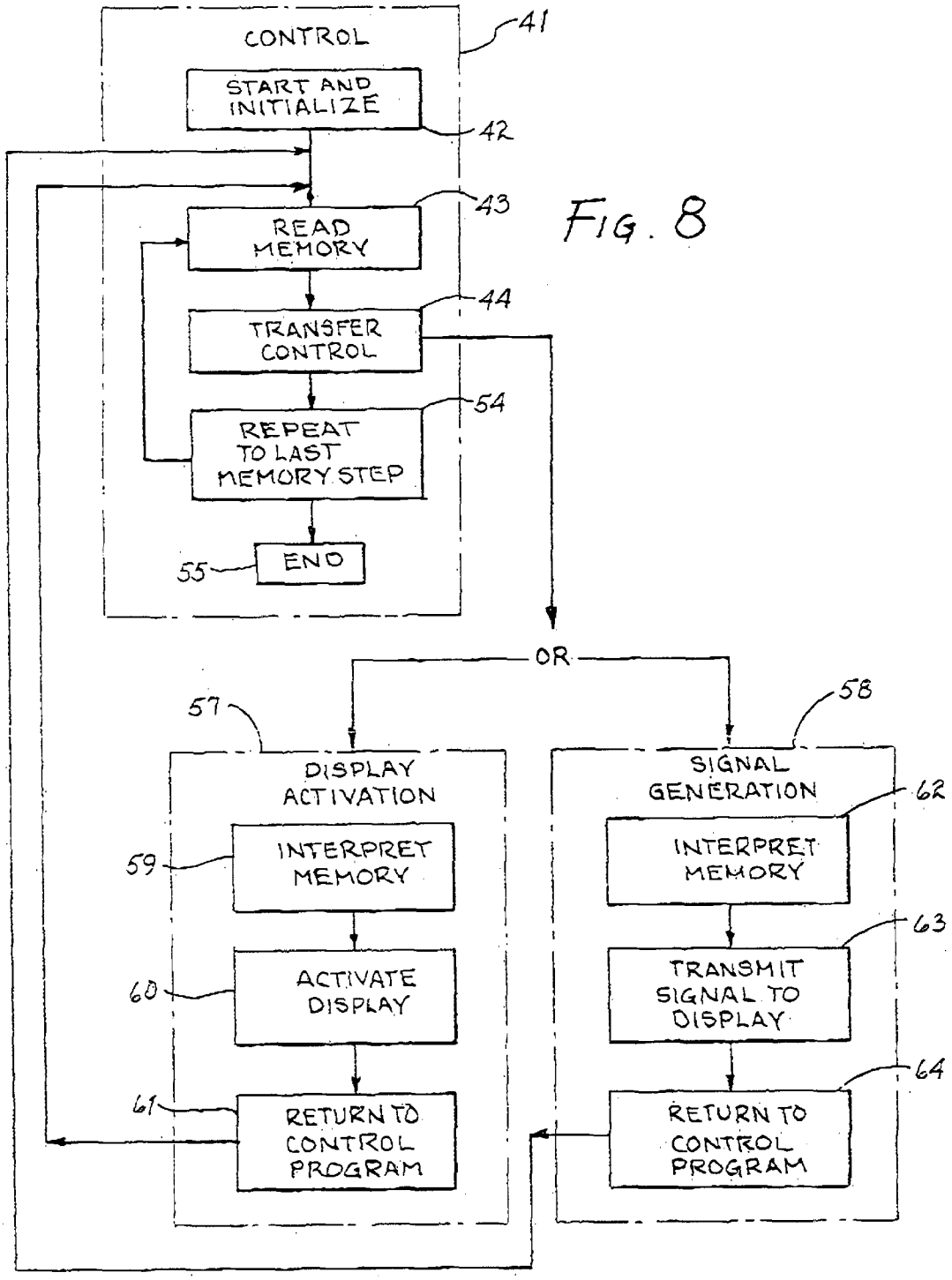
FIG. 8 is a block diagram which illustrates a typical program or logic function utilized in accordance with the presently preferred embodiment of the invention; and, FIG. 9 is a block diagram which illustrates a sensor system utilized in monitoring the frequency of use of the card catalogue by customers frequenting a particular business.

FIG. 8 is a block flow diagram which illustrates a typical program or logic function which is executed by the controller during operation of the audio system in card 15. The basic control program 41 consists of commands to "start and initialize" 42, "read memory" 43 and "transfer control" 44 to either the display activation sub-routine 57 or signal generation sub-routine 58.

The display activation sub-routine 57 consists of commands to "interpret memory" 59 (i.e., determine if memory 12 has received a signal 13B generated by depressing and releasing button 13), "activate display" 60 and "return to control program" 61. The signal generation sub-routine includes an "interpret memory" 62 step (i.e., obtain the jingle format from memory when the display is being activated), followed by "transmit signal to display" 63 (i.e., transmit jingle to speaker 14 to produce audible jingle for user of card 15), and "return to control program" 64. The display activation 57 and signal generation 58 sub-routines are repeated as indicated by the "repeat to memory step" 54 of the control program 41 followed by an "end" program step 55 which completes the execution of the program.

Figure 9:
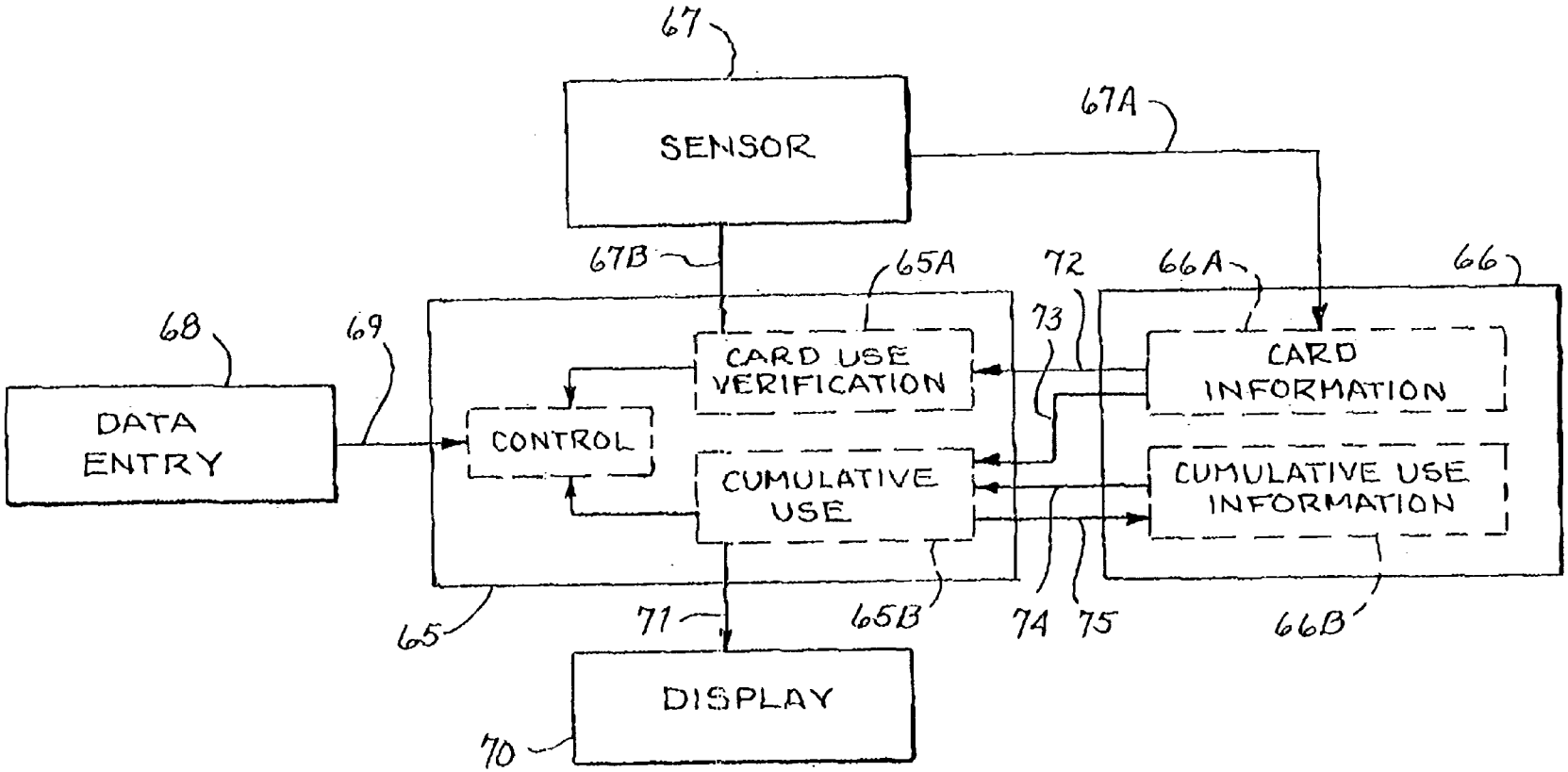

FIG. 9 is a block diagram which illustrates a preferred embodiment of a sensor system used by a business establishment to monitor the frequency with which a customer utilizes coupon catalogue apparatus constructed in accordance with the invention. The main components of the sensor systems are a sensor system controller 65 and a memory 66. A sensor 67, data entry 68, and display 70 are provided. The sensor 67 reads unique machine-readable indicia (for example, a bar code) on each card. The display can be a video display, audio display, printer, etc. Data entry 68 typically comprises a computer keyboard, but can consist of any means of entering commands, data, or other information into controller 65.

As indicated by the dashed lines, the controller 65 performs the dual function of card use verification 65A and cumulative use 65B. The memory 66 contains both card information 66A and cumulative use information 66B. After the sensor 67 provides bar code 24 information 67A from, for example a card 15, to memory 66A, the card use verification sub-routine 65A recalls 72, 73 card information 66A from memory 66 and confirms that bar code 24 information from a card 15 corresponds to a bar code distributed in the geographical area in which the business entity utilizing the sensor system is located. Once this is confirmed, the cumulative use sub-routine 65B recalls 74 the cumulative use information to determine if the bar code 24 has been previously read from card 15 during a prior visit(s) by the customer to the business entity. If the code 24 has been previously read, then the cumulative number of times by which the card has been used is incremented by one to produce a new cumulative number for that card. The new cumulative number is transmitted 75 into the cumulative use information. When the business entity wishes to determine the number of times a particular card or cards has been used at the business entity, the appropriate commands (for example the bar code number of the card or cards) are entered into controller 65 utilizing data entry 68, after which the controller 65 obtains the cumulative use information relating to the entered bar code numbers and displays the information on display 70.

In use, coupon catalogue apparatus of FIGS. 1 to 9 is distributed to a least one user in Arizona. The user stores the four card catalogue apparatus in his wallet with a four cards in registration one on top of the other. When the user wishes to select a business establishment for dining, he removes the catalogue apparatus from his wallet and fans the cards in the manner shown in FIG. 1 until he views the "DINING OUT" card 35 of FIG. 4. He selects the Hannibal Pizza establishment which is in Phoenix, Arizona and which is indicated by the source indicia 51 in area 64. On arriving at the Hannibal Pizza establishment he pays for one medium pizza and receives another free. The clerk at the Hannibal Pizza establishment scratchs off one of areas 29 from card 35, reads bar code 53 with sensor 67, and returns the coupon catalogue apparatus to the customer. The clerk at Hannibal Pizza then uses data entry 68 to interrogate control 65 to provide information concerning how many times during the past, week, month and year, etc. customers with "DINING OUT" cards which are, except for the different bar code number on each card, identical to card 15 have visited the clerk's Hannibal Pizza establishment. After receiving the clerk's interrogation, control 65 interrogates cumulative use information memory 66B to determine how many of the card numbers (each card number corresponding to a unique bar code number on a card 15) stored in card information 66A have been used at the Hannibal Pizza establishment and to determine how many times each card has been used. Control 65 displays this information on display 70. The card bar code numbers stored in card information 66 are the bar code numbers of cards distributed in the state of Arizona; consequently, the cumulative use information 66B pertains to cards which were distributed in Arizona and were used at the Hannibal Pizza establishment. The user depresses button 31 to cause a jingle to emanate audibly from speaker 14.

Rivet 56 ordinarily secures cards 55, 57, 35, and 15 together such that adjacent pairs of cards 35-57, 15-35, and 15-55 slide over one another when a deck of cards which are aligned and in registration one on top of the other is fanned into the orientation shown in FIG. 1. If desired, cards 55, 57, 35, and 15 can be pivotally interconnected so they do not slide over one another. Since, however, cards 55, 57, 35, and 15 ordinarily each slide over an adjacent card, using peel off stickers in the deck of the invention is not practicable. The sliding of cards over one another produces frictional forces which tend to cause peel off stickers to turn up at the corners and to be pulled off the cards. This is why the coupon cards described in U.S. Pat. No. 5,501,491 to Thompson do not slide over one another. Instead, a pair of card are attached along a line of weakening so that one card is folded over onto the other card.

Figure 3:
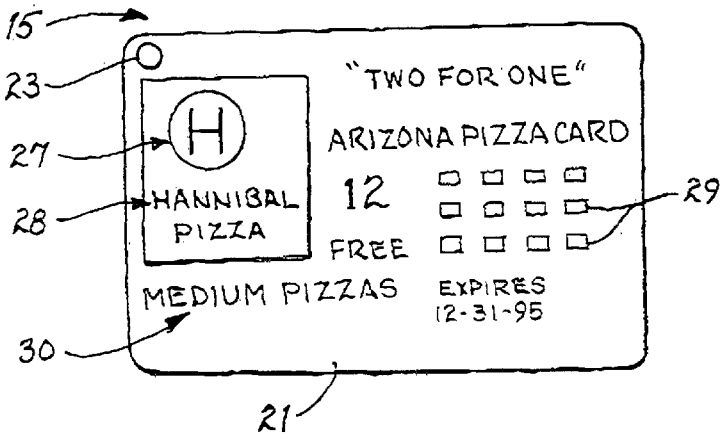
FIG. 3 is a front view further illustrating construction details the card of FIG. 2.

In one preferred embodiment of the invention, the deck of cards 57, 35, 15, 55 includes a plurality of cards each of which identifies only a single vendor as does card 15 in FIGS. 2 and 3. The use of a plurality of cards which each identifies only a single vendor has unexpectedly and surprisingly been found to be particularly attractive to customers utilizing the deck.

A further preferred embodiment of the invention is the use of one or more cards in a deck, which cards each (1) on one side (for example, the front of the card) include a single vendor and one or more alterable areas 29 (in the manner illustrated in FIG. 3) which are scratched or rubbed off, and (2) on the other side (for example, the back of the card) includes a plurality of vendors that each have one or more alterable areas 29 (in the manner illustrated in FIG. 4) which are associated with the vendor and which can be rubbed or scratched off.

Another preferred embodiment of the invention includes a deck including one or more cards which each (1) on one side of the card include a single food vendor and one or more alterable areas 29 which can be scratched or rubbed off, and (2) on the other side include one or more entertainment vendors and one or more alterable areas which are associated with each entertainment vendor and can be rubbed or scratched off. Food vendors include establishments which sell prepared food such as, by way of example and not limitation, MCDONALD'S (SM), LITTLE CAESERS PIZZA (SM), PETER PIPER PIZZA (SM), JACK IN THE BOX (SM), KENTUCKY FRIED CHICKEN (SM), SMITTY'S FAMILY RESTAURANTS AND FOOD COURTS (SM), CIRCLE K (SM), and BILL JOHNSON'S BIG APPLE (SM). Entertainment vendors include businesses which provide entertainment services such as, by way of example and not limitation, FIDDLESTICKS (SM), SCOTTSDALE FAMILY GOLF CENTER (SM), ENCHANTED ISLAND AMUSEMENT PARK (SM), OCEANSIDE ICE ARENA (SM), CASEY AT THE BAT (SM), SKATELAND (SM), GRAND CANYON RAILWAY (SM), RED RIVER OPRY (SM), WILDLIFE WORLD ZOO (SM), ASU ATHLETICS (SM), VALLEY YOUTH THEATRE (SM), PHOENIX ART MUSEUM (SM), DESERT BOTANICAL GARDEN (SM), and PIMA AIR & SPACE MUSEUM (SM).

When the coating or other material comprising an area 29 on a card 55, 57, 35, 15 is scratched or rubbed off, area 29 does not peel off or separate from the card in one unitary piece. Instead, the coating is separated or removed from the card in a plurality of particles, pieces, shavings, or fragments, often similar to the shavings produced when wood is planed.

A further preferred embodiment of the invention includes a deck including one or more cards which each (1) on one side of the card include a single entertainment vendor and one or more alterable areas 29 which can be scratched or rubbed off and (2) on the other side include one or more food vendors and one or more alterable areas which are associated with each food vendor and can be rubbed or scratched off.

The primary function of areas 29 is to be removed (typically by scratching or rubbing, although chemical or any other means can be utilized to remove or alter an area 29) to indicate usage of the deck. Areas 29 are not removed to reveal additional information that is necessary to use the goods or services provided by the vendor associated with the area 29 removed. The space beneath an area 29 often is blank such that when the area 29 is removed alphanumeric characters, drawings, etc. do not appear. This distinguishes areas 29 from areas which are removed from a lottery ticket to reveal whether or not the winning number or numbers is hidden underneath the areas removed. Such "scratch off" lottery tickets evidently are widely distributed, and are used once and discarded.

The purpose of removing areas 29 is to track the use of the deck during a customer's repeated periodic visits to the vendor associated with areas 29. Once an area 29 is removed, the name of the vendor still remains imprinted on the card and an accounting of the use of the card at that vendor is readily visually determined by viewing the vendor and the remaining areas 29 (if any) associated with the vendor. In order for the accounting system of the invention to function, the areas 29 associated with a vendor must appear on each identical card in a predetermined identical pattern, preferably a grid type pattern in which each area 29 in a row of areas 29 (where a row is a horizontally oriented series of areas 29) or column of areas 29 (where a column is a vertically oriented series of areas 29) is equidistant from adjacent areas 29 in the row or column. For example, in FIG. 3, the areas 29 comprise a grid pattern including three rows and four columns. The areas 29 in each row are equally spaced, as are the areas 29 in each column. Similarly, in FIG. 4 the row of areas 29 in each area 39, 40, 61 to 64, 45 to 50 comprises a grid pattern in which areas 29 are equally spaced. In a like manner, at least two areas 39, 40, 61 to 64, 45 to 50, and preferably all such areas, on the back or front of a card are of equal shape and dimension and the size and configuration of areas 29 in each area 39, 40, 61 to 64, 45 to 50, is the same (in the manner illustrated in FIG. 4). When the grid pattern of areas 29 associated with a vendor is known and/or the number of areas 29 associated with a vendor is known, it is a straightforward matter to determine if a user of a deck has visited that vendor, i.e., it is a straightforward matter to determine how many (if any) of areas 29 associated with that vendor have been scratched, rubbed, or otherwise removed from a card. This especially the case when a limited number of areas 29 are associated with a particular vendor. Although the number of areas 29 assocaited with a vendor can vary as desired, it is normally no more than fifteen areas 29 are associated with a particular vendor, and preferably no more than twelve areas 29 are associated with a particular vendor on a card.

One of the preferred offers made on a card 55, 57, 35, 15 in the deck of the invention is the "two for one" or "buy one get one free" offer. Consequently, if the vendor is MCDONALD'S, the offer may be "Buy One Egg McMuffin, Get One Free". When a user visits a MCDONALD'S restaurant, if he (or she) buys one EGG MCMUFFIN (TM), he gets another free, and one of the personnel in the restaurant scratches off one of the areas 29 associated the "Buy One Egg McMuffin, Get One Free" offer. This type of offer is also illustrated on the card shown in FIG. 3. Only one area 29 associated with a vendor can be utilized and scratched off during a visit to the vendor. The remaining areas 29 must each be utilized on a separate later visit to the vendor, i.e. must be utilized after the customer has left and later returned to the vendor.

Imprinting designs on cards has been known for centuries. Playing cards probably originated in China or in Hindustan about A.D. 800. They appeared in Italy by the late 1200's. The imprinting of alphanumeric characters on cards also has long been known. The World Book Encyclopedia (1989) at page 209 of the C volume illustrates a playing card upon which an invitation to a social event was inscribed in America in the 1800's.

Pivotally attaching items so they may be opened like a hand-held fan has long been known. U.S. Pat. No. 2,790,319 to Brunner depicts a plurality of keys pivotally mounted side-by-side on an elongate straight cylindrical rod. The hand-held fan is used to cool a person and usually has the form of a segment of a circle and consists of material (as feathers, paper or silk) mounted on thin rods or slats moving about a pivot so that the device may be closed compactly when not in use and can, in order to be used, be opened or "fanned" into a configuration representing the segment of a circle. The hand-held fan is believed by historians to have been invented in Japan about A.D. 700. In the 1500's the Portuguese brought it to Europe.

A primary advantage of the coupon catalogue apparatus of the invention is that enables $3000.00 to $5000.00 (or more) of free goods and services to be offered in a small compact deck. This is especially the case when (1) vendors and areas 29 adjacent and associated with the vendors are printed on both sides of cards included in the deck of cards, and (2) the cards include "buy one get one free" offers.

Having described my invention and the presently preferred embodiments thereof in such terms as to enable those skilled in the art to understand and practice it, I claim:

1. An article of manufacture comprising a coupon catalogue apparatus including:

(a) a plurality of cards of substantially equal shape and dimension each having a first and second side and a peripheral edge;

(b) means for pivotally attaching the cards at a point adjacent the peripheral edge of each of the cards to maintain the cards in a stacked registered configuration and to permit the cards to pivot about said point to fan out from said stacked registered configuration and to permit adjacent cards to slide over one another;

(c) at least one goods source indicia on the first side of at least one of the plurality of cards identifying a source of discounted goods offered to a bearer of the card;

(d) at least one goods confirmation indicia on said first side of the at least one of the plurality of cards associated with said goods source indicia on said first side and alterable to confirm that a bearer of the catalogue used the catalogue to obtain the goods offered by said source of the goods identified on said first side;

(e) at least one entertainment source indicia on the second side of at least one of the plurality of cards identifying a source of discounted services offered to a bearer of the card; and (f) at least one entertainment confirmation indicia on said second side of the at least one of the plurality of cards associated with said entertainment source indicia on said second side and alterable to confirm that a bearer of the catalogue used the catalogue to obtain entertainment offered by said entertainment source identified on said second side.

2. The article of manufacture comprising a coupon catalogue apparatus of claim 1 wherein at least one of said goods confirmation indicia and said entertainment confirmation indicia consists solely of at least one of words and images concealed by a scratch-off type material.

3. The article of manufacture comprising a coupon catalogue apparatus of claim 1 wherein at least one of said first and second sides of at least one of said plurality of cards comprises means for playing an audio message.

* * * * *